United States Patent [19]

Goodrich

[11] Patent Number: 4,969,405

[45] Date of Patent: Nov. 13, 1990

[54] INCINERATORS

[75] Inventor: Keith J. Goodrich, Wacol, Australia

[73] Assignee: Jandu Pty. Ltd., Queensland, Australia

[21] Appl. No.: 353,659

[22] PCT Filed: Nov. 5, 1987

[86] PCT No.: PCT/AU87/00373

§ 371 Date: May 5, 1989

§ 102(e) Date: May 5, 1989

[87] PCT Pub. No.: WO88/03634

PCT Pub. Date: May 19, 1988

[30] Foreign Application Priority Data

Nov. 5, 1986 [AU] Australia ..... PH8819

[51] Int. Cl.[5] ..... F23B 5/00

[52] U.S. Cl. ..... 110/210; 110/235; 110/248; 110/244

[58] Field of Search ..... 110/235, 248, 255, 269, 110/285, 293, 210, 211

[56] References Cited

U.S. PATENT DOCUMENTS

| | | | |
|---|---|---|---|
| 3,707,128 | 12/1972 | Lang | 110/210 |
| 3,780,674 | 12/1973 | Liu | 110/248 |
| 4,337,711 | 7/1982 | Bolton | 110/235 |
| 4,356,778 | 11/1982 | McRee, Jr. | 110/248 |
| 4,452,152 | 6/1984 | John et al. | 110/235 |
| 4,531,462 | 7/1985 | Payne | 110/210 |
| 4,557,203 | 12/1985 | Mainord | 110/210 |

*Primary Examiner*—Henry C. Yuen

*Attorney, Agent, or Firm*—Larson and Taylor

[57] ABSTRACT

In an incinerator of the type having a combustion chamber (10) which may be loaded through a loading doorway (21) and having at least one burner (32) for directing ignited fuel oil or gas and/or combustion air under pressure into the chamber, the combustion chamber (10) is of elliptical shape in plan view, the burner (32) entering the chamber at one end of its long axis and being directed obliquely down to the chamber bottom at its opposite end, the chamber top having a gas outlet (17) at the same end as the burner (32). The incinerator may be of two-stage type, having superimposed on the said chamber, or primary chamber (10), a secondary chamber (11) of similar elliptical shape having at one end of its long axis an entry from the gas outlet (17) of the primary chamber (10), a burner (32) directed obliquely down to the secondary chamber bottom (16) at its opposite end, and an outlet from its top to a flue. The incinerator is loaded from a feeder mechanism (33) with a bin (36) for receiving waste to be incinerated, a pusher blade (41) in the bin being advanced to force the waste through an open end of the bin through the incinerator's loading doorway (21).

7 Claims, 3 Drawing Sheets

INCINERATORS

BACKGROUND OF THE INVENTION (1) Field of the Invention

THIS INVENTION relates to improvements in incinerators.

(2) Prior Art

Incinerators for municipal, hospital and veterinary use are required to be particularly efficient in the disposal of waste materials. Such an incinerator is commonly of two-stage type, with primary combustion carried out in a first chamber, gases, including unburnt gases, from the first chamber being conveyed to a second chamber for completion of the incineration process before escape by way of a flue.

SUMMARY OF THE PRESENT INVENTION

The general object of the present invention is to provide an incinerator which is particularly efficient in operation.

With the foregoing and other objects in view, the invention resides broadly in an incinerator of the type having at least one combustion chamber which may be charged by way of a loading door, a burner being directed into the chamber and a gas outlet leading from the chamber to a flue, wherein:

the chamber is of substantially elliptical shape in plan view;

the burner is located at one end of the long axis of the ellipse, being directed obliquely down towards the bottom of the chamber at the opposite end of the long axis; and the gas outlet from the top of the chamber, is from the same end of the chamber's long axis as the burner.

Preferably the incinerator is of two-stage type with a primary combustion chamber the gas outlet from which enters an end of the bottom of a secondary combustion chamber of similar elliptical form superimposed on and aligned with the primary chamber.

Preferably the loading door is located to direct waste material to be incinerated to the short axis of the elliptical primary chamber. This waste material is preferably fed through the loading door by a feeder mechanism including a bin to receive the waste and of which the rear end leads to the loading doorway, a pusher blade being located in the bin and drive means being provided for advancing the pusher blade to force waste material from the bin through the loading doorway.

Other features of the invention will become apparent from the following description.

BRIEF DESCRIPTION OF THE DRAWINGS

In order that a preferred embodiment of the invention may be readily understood and carried into practical effect, reference is now made to the accompanying drawings, wherein.

DETAILED DESCRIPTION OF THE PREFERRED EMBODIMENT

Figure 1:
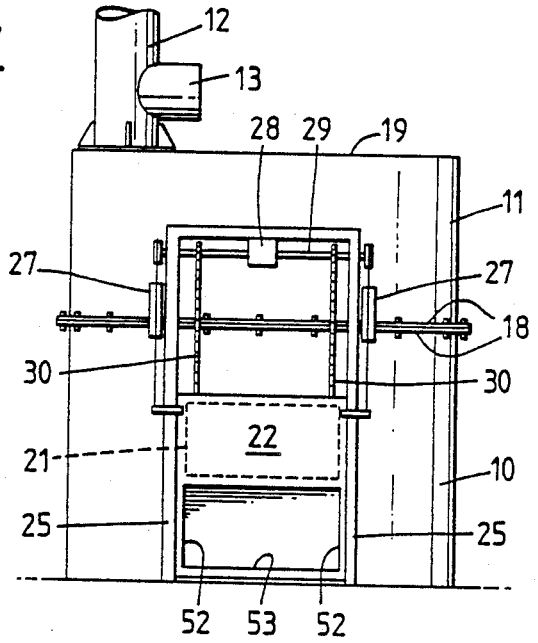
FIG. 1 is a front elevational view of an incinerator according to the invention, its feeder mechanism being omitted.
Figure 2:
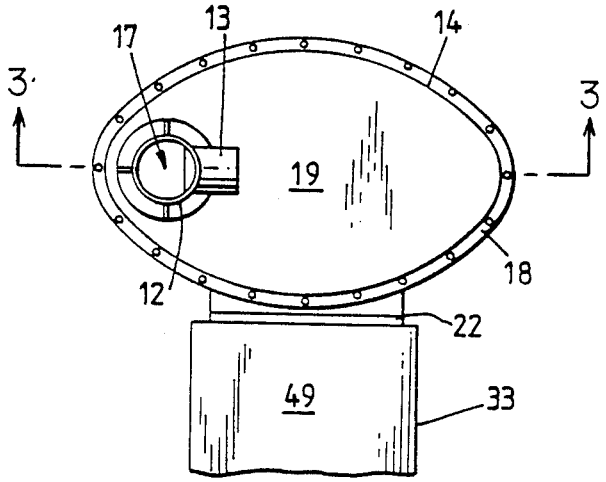
FIG. 2 is a partly broken-away plan view of the incinerator.
Figure 3:
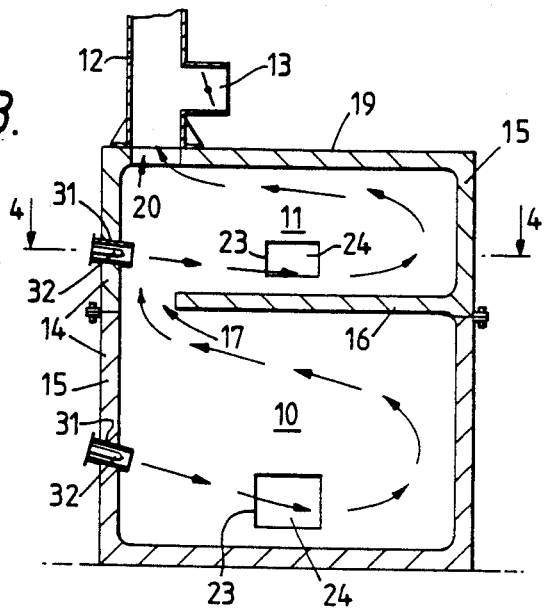
FIG. 3 is a sectional view of the incinerator taken along line 3—3 in FIG. 2.
Figure 4:
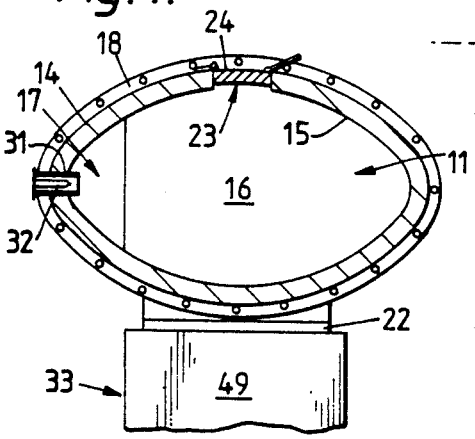
FIG. 4 is a cross-sectional view of the incinerator taken along line 4—4 in FIG. 3.

The incinerator illustrated in FIGS. 1 to 4 is substantially elliptical in plan view and of two-stage type, comprising a primary or lower chamber 10 upon which is superimposed a secondary or upper chamber 11, from which there leads a flue 12 with a draught control 13.

Each of the primary chamber 10 and secondary chamber 11 has a steel outer casing 14 and a lining 15 of a castable refractory material within its wall and within the bottom of the primary chamber and the top of the secondary chamber. Additionally, the secondary chamber is formed with a bottom 16 of a castable refractory material, reinforced in any suitable way, for example by incorporation of stainless-steel fibres in the refractory material. This part forms, between the primary chamber 10 and the secondary chamber 11, a partition which terminates some distance short of one end of the long axis of the primary and secondary chambers to leave a passage 17 from the one to the other. The two chambers are held together in superimposed and aligned arrangement by bolting together attachment flanges 18 about the top of the primary chamber and the bottom of the secondary chamber.

The flue 12 extends up from the top 19 of the steel casing 14 leading from an opening 20 through lining 15 and casing top at the same end of the incinerator as the passage 17 from the primary chamber 10 to the secondary chamber 11.

The primary chamber has in its front a loading doorway 21 which may be closed by a loading door 22. Each of the two chambers 10 and 11 has, in its rear, a clean-out opening 23 normally closed and sealed by a hinged door 24.

The loading door 22 is vertically movable in a pair of upright guides 25 forming parts of a door mounting frame 26 at the front of the incinerator. The door is counterbalanced by a pair of counterweights 27 and it may be raised to open position or lowered to closed position by an electric motor and gearbox assembly 28 at the head of the mounting frame 26 and driving a shaft 29 carrying sprockets for lifting chains 30 connected to the door 22.

A burner port 31 is installed through an end of each of the primary and secondary chambers 10 and 11, being at the same end of the long axis of the elliptical-cross-section chamber as the passage 17 between the chambers. In each of these ports there is installed an oil or gas burner assembly 32, directed obliquely downwards towards the opposite end of the long axis of the chamber bottom. Each of the burner assemblies is of the type capable of projecting air under pressure together with the fuel oil or gas, or alternatively air alone.

Figure 6:
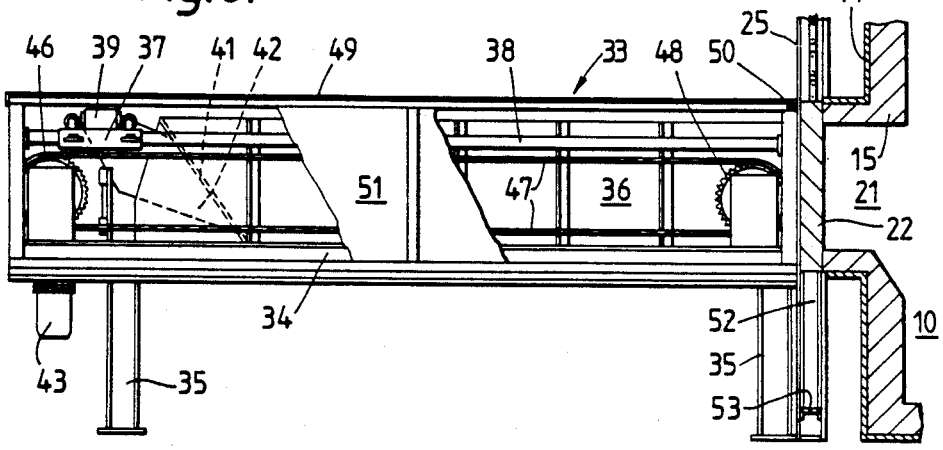
FIG. 6 is a partly broken-away side elevation of the incinerator feeder mechanism.
Figure 7:
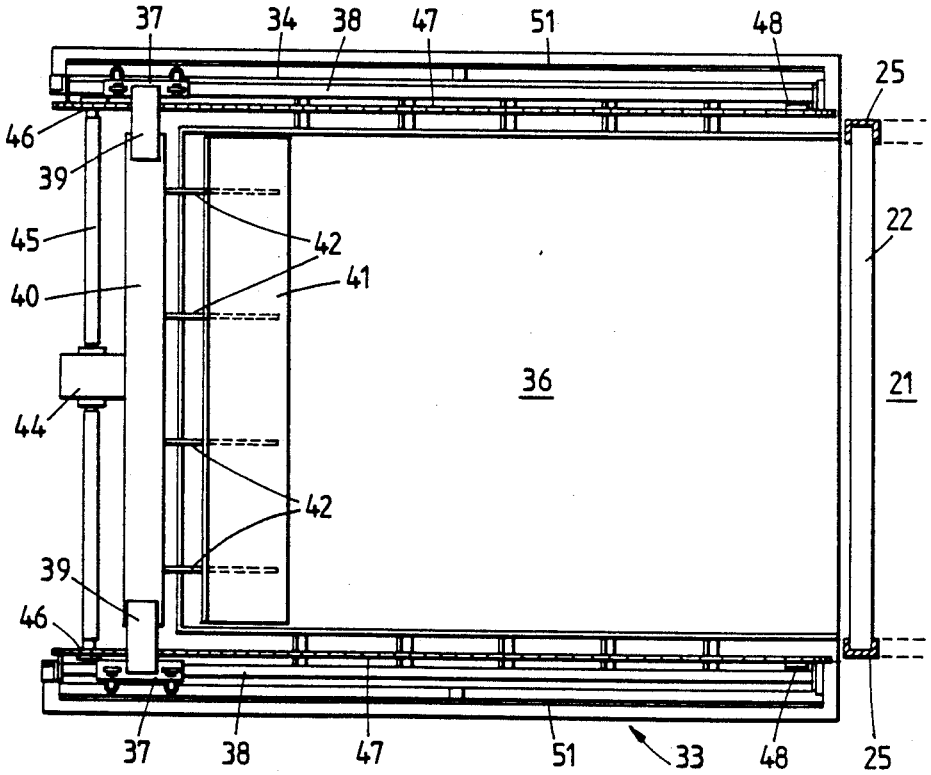
FIG. 7 is a plan view of the feeder mechanism.

The loading mechanism for the incinerator is indicated generally at 33 and shown particularly in FIGS. 6 and 7. It includes a sturdy rectangular main frame 34 mounted on legs 35 and located directly to the front of the loading doorway 21. The main frame carries a rectangular loading bin 36, open at the top and at its rear end which is aligned with the incinerator's loading doorway 21. A pair of roller-mounted travellers 37 are movable along a pair of parallel horizontal rails 38 mounted on the main frame 34 outwards of the bin sides and are connected by a pair of bridging brackets 39 to the ends of a transverse beam 40.

An oblique pusher blade 41 located within the bin 36 is connected by a series of carrier brackets 42 to the beam 40.

An electric motor 43 at the front of the main frame 34 operates through a gearbox 44 to drive a transverse shaft 45 carrying a pair of sprockets 46. A pair of endless chains 47 are mounted on these sprockets and on a pair of idler sprockets 48 at the rear of the main frame, and are connected to the two travellers 37.

The bin 36 can be charged with material to be fed to the incinerator only when a lid 49 (omitted from FIG. 7) has been lifted to its open position.

This lid is pivoted at 50 to the main frame 10 so that it can be raised hingedly close to the front of the incinerator, to give ,access to the bin 36, or lowered to closed position onto outer side plates 51 mounted on the main frame 34 outwardly of the bin and the principal working parts of the feeder mechanism. Any suitable means may be provided for raising or lowering the lid.

With the lid 49 in its raised or open position, the bin 36 may be charged with material to be incinerated. Any suitable control means are provided whereby the loading door 22 cannot be opened by the motor 28 until the lid 49 has been closed and so held by any suitable catch (not shown). Only when the lid is closed and the loading door 22 is opened, can the motor 43 be operated to act, through the chain 47, to advance the pusher blade 41 to feed combustible material from the bin through the loading doorway 21 and into the primary chamber 10 of the incinerator.

A pair of legs 52 depending from the sides of the loading door 22 carry a transverse sill channel 53 which, when the door 22 has been raised to fully opened position, is brought level with the bottom of the loading doorway 21 to prevent any material ejected from the bin 36 from falling between the bin and the incinerator.

With the material to be incinerated fed into the primary chamber 10, the motor 43 is automatically reversed to retract the pusher blade 41 and the motor 28 is operated automatically to close the loading door 22. When the pusher blade has been fully retracted and the motor 43 automatically stopped, the catch of the lid 49 is released and the lid 49 may be brought to open position.

The burners 32 are ignited and the introduced material is incinerated in the primary chamber 10. Gases unburned in the primary chamber pass through the passage 17 into the secondary chamber and are consumed therein. The oblique arrangement of the burner assemblies 32 results in flame and combustion air under pressure being directed towards the opposite end of the incinerator chambers, causing the burning gases in the incinerator to follow circuitous paths as indicated by arrows in FIG. 3. This, as well as the elliptical shape of the chambers 10 and 11 which produces no relatively undisturbed corners, has been found to bring about very efficient and thorough combustion. The introduction of fuel gas or oil may be interrupted when the temperature is indicated, by any suitable sensor means, to have reached a predetermined level, only combustion air being introduced to the incinerator unless and until the temperature drops to a predetermined extent.

Figure 5:
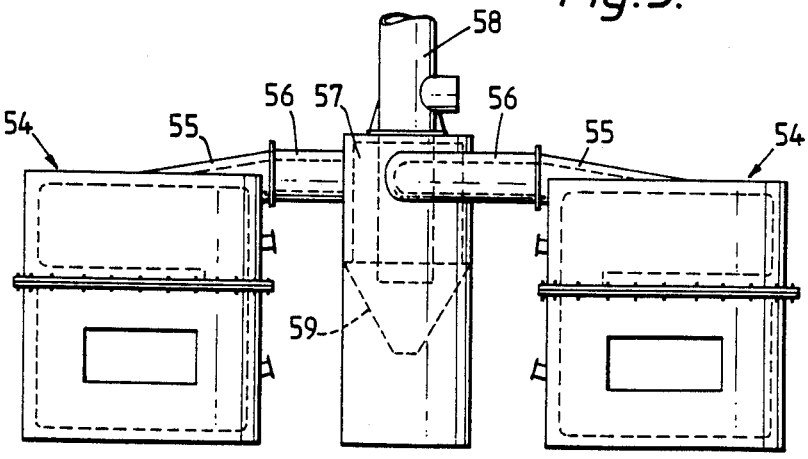
FIG. 5 is a diagrammatic view of a double incerator installation.

In the arrangement shown more or less diagrammatically in FIG. 5, two incinerators 54 are generally as before described except in that their flues 55 leave the incinerators obliquely instead of vertically, and are connected to lagged horizontal conduits 56 which lead tangentially into opposite sides of the upper part of a cyclone 57. Gases from the incincerator flues 55 entering the cyclone are induced to follow a swirling path downwards to enter the bottom end of a vertical flue 58, and any solids entrained with the gases will fall, by way of a funnel 59, into the bottom of the cyclone from which they may be removed from time to time.

Incinerators according to the invention will be found to be very effective in achieving the objects for which they have been devised. The particular embodiments illustrated may be subject to many modifications of constructural detail and design. For example, instead of an incinerator being of two-stage type, it may be of single stage type for simpler incinerating functions, the secondary chamber being omitted. Again, in certain conditions it may be preferred to upgrade the incinerator to three-stage type, a further chamber being interposed between the primary chamber and the secondary chamber described and illustrated. The top of the uppermost chamber of the incinerator, instead of being flat as shown in the drawings, may be domed, and the partition 16 may also be domed for additional strength in larger-size incinerators.

The foregoing and many other modifications are considered to lie within the ambit of the invention hereinafter claimed.

I claim:

1. An incinerator comprising:

a primary combustion chamber which is of substantially elliptical shape in plan view;

a loading door by which the combustion chamber is charged;

a burner directed into the primary chamber, the burner being located at one end of the long axis of the ellipse of the primary chamber, and being directed obliquely down towards the bottom of the primary chamber at the opposite end of the long axis;

a gas outlet leading from the primary chamber to a flue, the gas outlet being from the top of the primary chamber at the same end of the primary chamber's long axis as the burner;

a secondary combustion chamber superimposed on the primary chamber and having a configuration in plan view of similar substantially elliptical form, said gas outlet from the primary combustion chamber opening through a bottom of the secondary chamber at an end of its long axis;

a burner at the same end of the long axis of the secondary chamber which is directed obliquely down towards the bottom of the secondary chamber to the opposite end of its long axis; and a gas outlet at the same end of the long axis of the secondary chamber which leads from a top of the secondary chamber.

2. An incinerator according to claim 1 wherein:

the loading door is located to open into the bottom of the chamber in the direction of the short axis of the elliptical primary chamber.

3. An incinerator according to claim 1 wherein:

each of the primary and secondary combustion chambers include a steel outer casing of substantially elliptical shape in plan view, that of the primary chamber having a steel bottom and a top peripheral flange, that of the secondary chamber having a steel top and a bottom peripheral flange secured to the flange of the primary chamber;

linings of a castable refractory material are applied within the elliptical wall and bottom of the primary chamber and within the elliptical wall and top of the secondary chamber;

the secondary chamber has a bottom of castable refractory material; and a clean-out door is provided for each of the primary and secondary chambers.

4. An incinerator according to claim 1 wherein there is provided a loading mechanism including:

a bin for receiving waste to be incinerated, and with an open end leading to the loading doorway a pusher blade is located transversely in the bin; and means are provided for advancing the pusher blade to load material from the bin through the incinerator loading doorway, and for retracting the pusher blade.

5. An incinerator according to claim 4 wherein:

means are provided for lifting the loading door to its open position and lowering it to its closed position; and means are provided for restraining the pusher blade from advancing when the loading door is in its closed position.

6. An incinerator according to claim 1 wherein:

the bin is provided with a lid; and means are provided for restraining the lid from being opened unless the pusher blade is in its retracted position.

7. An incinerator comprising:

at least one primary combustion chamber which is of substantially elliptical shape in plane view;

a loading door by which the primary combustion chamber is charged, said loading door being located to open into the bottom of the primary combustion chamber in the direction of the short axis of the elliptical primary combustion chamber;

a primary burner directed into the primary combustion chamber, the primary burner being located at one end of the long axis of the ellipse of the primary combustion chamber and in the bottom half of said primary combustion chamber, and being directed obliquely down towards the bottom of the primary combustion chamber at the opposite end of the long axis;

a primary gas outlet through which exits all of the gases from the primary combustion chamber, the primary gas outlet being located at the top of the primary combustion chamber at the same end of the long axis of the primary combustion chamber as the primary burner;

a discrete secondary combustion chamber superimposed on the primary combustion chamber, said secondary combustion chamber being of a similar substantially elliptical shape in plan view;

a secondary gas inlet for the secondary combustion chamber connected to the primary gas outlet of all of the gases of the primary combustion chamber, said secondary gas inlet being located in a bottom of the secondary combustion chamber at an end of the long axis thereof;

a secondary burner located at the same end of the long axis of said secondary combustion chamber as said secondary gas inlet and in the bottom half of said secondary combustion chamber, said secondary burner being directed obliquely down towards the bottom of said secondary combustion chamber to the opposite end of the long axis thereof; and a secondary gas outlet at the same end of the long axis of said secondary combustion chamber as said secondary gas inlet which leads from a top of said secondary combustion chamber to a flue.

* * * * *